US012291962B2

(12) United States Patent
Koo et al.

(10) Patent No.: US 12,291,962 B2
(45) Date of Patent: May 6, 2025

(54) WIRELINE PARAMETER ESTIMATION IN RUNTIME WITH DOWNHOLE TOOL DEPLOYED IN THE BOREHOLE

(71) Applicant: Halliburton Energy Services, Inc., Houston, TX (US)

(72) Inventors: Colin Eu Leem Koo, Singapore (SG); Hugh Douglas, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 69 days.

(21) Appl. No.: 18/342,354

(22) Filed: Jun. 27, 2023

(65) Prior Publication Data

US 2025/0003333 A1 Jan. 2, 2025

(51) Int. Cl.
*E21B 47/13* (2012.01)

(52) U.S. Cl.
CPC ..... *E21B 47/13* (2020.05)

(58) Field of Classification Search
CPC ..... E21B 47/00; E21B 47/01; E21B 47/12; E21B 47/13; E21B 23/14; H04B 2203/5475
See application file for complete search history.

(56) References Cited

U.S. PATENT DOCUMENTS 7,586,313 B2 * 9/2009 Hernandez-Marti ..... G01V 11/002 702/6
2003/0098673 A1 5/2003 Hernandez
2004/0189486 A1 9/2004 Dodge et al.
2008/0265898 A1 10/2008 Hernandez-Marti et al.
2016/0072280 A1 3/2016 Bourgeois, Jr.
2022/0148761 A1 5/2022 Crane et al.

FOREIGN PATENT DOCUMENTS

GB 2386143 A * 9/2003 ..... E21B 23/00

OTHER PUBLICATIONS

"PCT Application No. PCT/US2023/069310, International Search Report and Written Opinion", Mar. 14, 2024, 10 pages.

* cited by examiner

*Primary Examiner* — Franklin D Balseca
(74) *Attorney, Agent, or Firm* — DeLizio, Peacock, Lewin & Guerra LLP

(57) ABSTRACT

A method comprises deploying, in a borehole, a downhole tool coupled to a surface system by a wireline and repeating the following operations while the downhole tool is powered on and being deployed in the borehole, obtaining surface measurements, via surface sensors, and downhole measurements, via downhole sensors, determining a DC resistance of the wireline based on the surface measurements and the downhole measurements, injecting a step signal into the wireline from the surface system, determining AC aspects of the wireline based the surface measurements and the downhole measurements at a time period after injecting the step signal into the wireline, and controlling a bus voltage of the downhole tool based on the DC resistance and the AC aspects.

20 Claims, 6 Drawing Sheets

WIRELINE PARAMETER ESTIMATION IN RUNTIME WITH DOWNHOLE TOOL DEPLOYED IN THE BOREHOLE

TECHNICAL FIELD

This disclosure relates generally to the field of wireline operations and more particularly to the field of determining wireline parameters during wireline operations.

BACKGROUND

In hydrocarbon recovery operations, a downhole tool may be deployed, via a wireline, in a borehole formed in a subsurface formation to measure properties of the borehole and/or the subsurface formation. The downhole tool may rely on communication with the surface while running in and/or out of the borehole for data transmission and command execution. As the wireline unspools when deploying the downhole tool in the wellbore, parameters of the wireline change resulting in a change in the strength and/or quality of the communication signal. For example, dynamic changes to the bus voltage during the runtime of the downhole tool may need to be communicated back to the surface. Wireline parameters, such as the alternating current (AC) aspects and direct current (DC) a of the wireline, may need to be considered while the downhole tool is being deployed such that the downhole tool bus voltage can be regulated and/or controlled.

BRIEF DESCRIPTION OF THE DRAWINGS

Embodiments of the disclosure may be better understood by referencing the accompanying drawings.

DESCRIPTION

Figure 1:
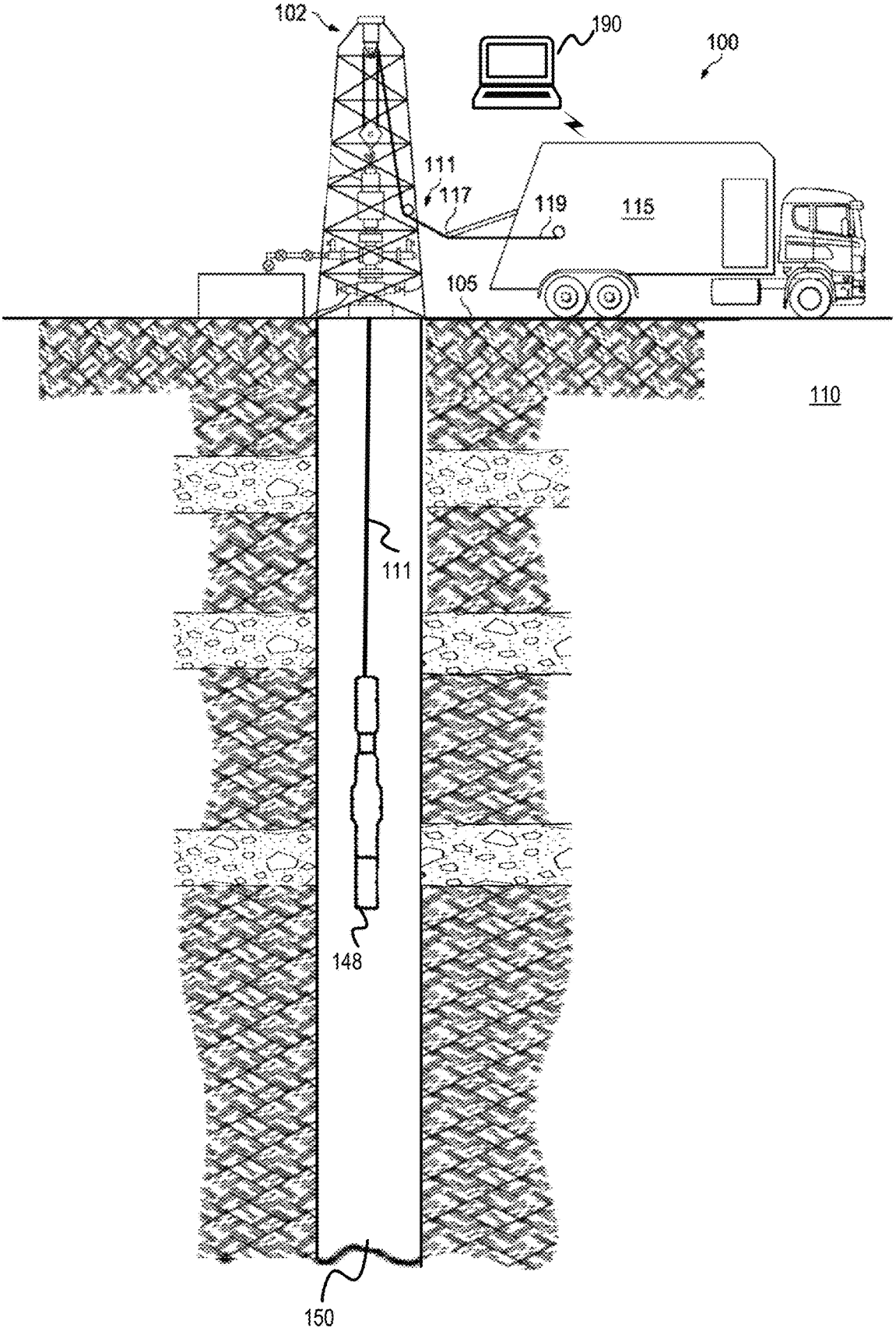
FIG. 1 is a conceptual diagram depicting an example wireline system, according to some implementations.

The description that follows includes example systems, methods, techniques, and program flows that embody aspects of the disclosure. However, it is understood that this disclosure may be practiced without these specific details. For instance, this disclosure refers to determining wireline armor resistance and wireline inductance. Aspects of this disclosure can also be applied to determining other AC aspects of the wireline in determining the wireline impedance. For clarity, some well-known instruction instances, protocols, structures, and operations have been omitted.

Example implementations relate to continuously determining the wireline impedance while a downhole tool is deployed in a borehole when the wireline cable is unspooling. Being the only connection between a surface system and the downhole tool, the wireline may provide power and communication between a surface system and downhole systems (e.g., a downhole tool). Thus, any control and regulation of the downhole tool bus voltage from the surface system may require a good model of the wireline to achieve accurate, fast, and reliable control. The unspooling of the wireline cable may cause the wireline impedance to change which may need to be accounted for when regulating the downhole tool bus voltage. In some implementations, the wireline impedance may be determined by determining the DC resistance of the wireline and AC aspects of the wireline. Conventional approaches may measure the wireline DC resistance in runtime without any AC aspects and transient characteristics. The DC resistance of the wireline may be a critical parameter that may be utilized to adjust the downhole tool voltage to a desired setpoint. However, the lack of AC aspects in the DC resistance parameter may limit the control response time when reacting to dynamic changes in the downhole tool bus load. Alternatively, other approaches may determine the impedance by utilizing two voltages, where the second voltage may be greater than the first voltage and both voltages may be lower than the activation voltage of the downhole tool. However, this method may only determine the wireline parameters when the downhole tool is powered down.

In some implementations, the wireline DC resistance and AC aspects of the wireline (wireline parameters) may be continuously determined while the downhole tool is powered up and being deployed in and/or out of the borehole. A surface system may be positioned on the surface and may include surface sensors configured to measure surface voltage and surface current (i.e., surface measurements). Downhole sensors may be coupled to the downhole tool and configured to measure downhole voltage and downhole current (i.e., downhole measurements). In some implementations, the surface and downhole measurements may be obtained to determine the DC resistance of the wireline. A step signal may then be injected, via the surface system, into the wireline with a downhole calibration resistor connected. AC aspects of the wireline may then be determined based on the surface and downhole measurements for a time period after the injection of the step signal. In some implementations, the downhole tool bus voltage may then be controlled and/or regulated based on the DC resistance and the AC aspects of the wireline. For example, the surface voltage may be adjusted to account for the DC resistance and the AC aspects such that a desired downhole tool bus voltage may be maintained. The ability to determine the wireline parameters in runtime without powering off the downhole tool may be advantageous for downhole tool operations. The wireline parameters can be continuously updated as the downhole tool is deployed in the borehole. This may facilitate and/or improve the control accuracy and response time when regulating the downhole tool bus voltage for varying loads.

Example System

FIG. 1 is a conceptual diagram depicting an example wireline system, according to some implementations. FIG. 1 depicts a wireline system 100 having a downhole tool 148 operating inside a borehole 150. While example operations are described in reference to the wireline system 100 of FIG. 1, example embodiments can be used in other downhole systems used in other stages of downhole operations.

Figure 6:
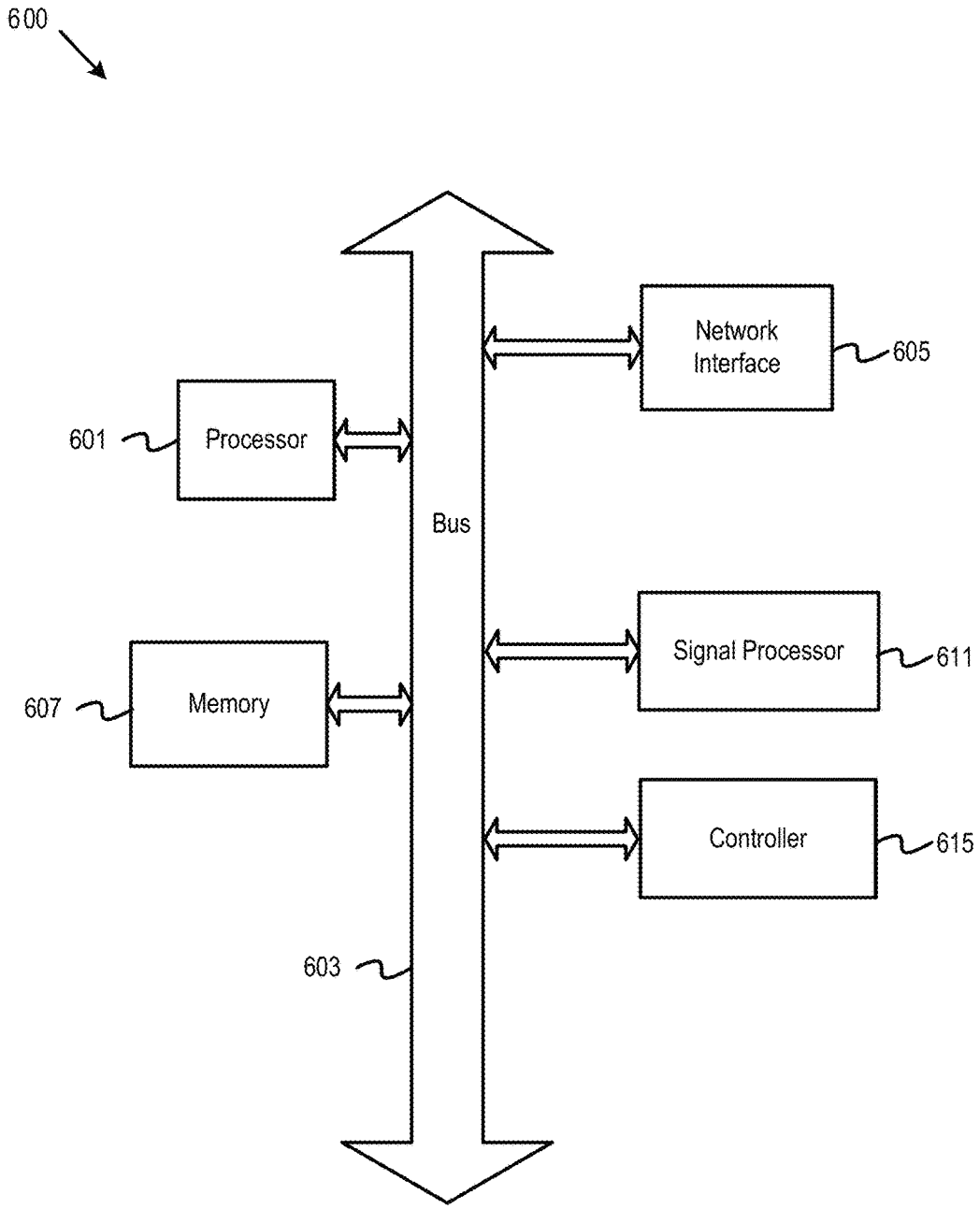
FIG. 6 is a block diagram depicting an example computer, according to some embodiments.

The wireline system 100 includes a surface system above a surface 105 and the borehole 150. The surface system may be coupled to the downhole tool 148 via a wireline 111. In general, the surface system provides power, material, and structural support for the operation of the downhole tool 148. In this example, the surface system includes a drilling rig 102 and associated equipment, and a data logging and truck 115. The truck 115 can include a computer 190 and other devices to monitor data logging operations by the downhole tool 148. In some embodiments, the computer 190 can be local or remote to the wellsite. A processor of the computer 190 may perform operations, such as determining the impedance of the wireline. In some embodiments, the processor of the computer 190 can receive and store logging data from the downhole tool 148 and/or control and downhole tool operations, such as control and regulate the bus voltage of the downhole tool 148. An example of the computer 190 is depicted in FIG. 6, which is further described below.

Below the drilling rig 102 is the borehole 150 extending from the surface 105 into the earth 110 and passing through a plurality of subsurface formations. The borehole 150 penetrates through the geologic formations and in some implementations forms a deviated path, which may include a substantially horizontal section. The borehole 150 may be reinforced with one or more casing strings. The wireline 111 can be spooled out at the surface by the truck 115. A cable tension sensing device 117 is located at the surface and provides cable tension data to the truck 115. A speed sensor device 119 located at the surface provides surface cable speed data to the truck 115.

In some implementations, the downhole tool 148 can include sensors and other instruments to measure borehole and/or formation properties at different depths of the borehole 150. Additionally, sensors may be positioned on the downhole tool 148 to measure downhole electronic signals (e.g., current, voltage, etc.) from the wireline 111. The downhole tool 148 may transmit these different measurements to the surface via the wireline 111 for further data processing (as further described below).

Although FIG. 1 depicts specific borehole configurations, it should be understood by those skilled in the art that the present disclosure is equally well suited for use in wellbores having other orientations including vertical wellbores, horizontal wellbores, slanted wellbores, multilateral wellbores, and the like. Also, even though FIG. 1 depicts an onshore operation, it should be understood by those skilled in the art that the present disclosure is equally well suited for use in offshore operations. Moreover, it should be understood by those skilled in the art that the present disclosure is not limited to the environments depicted in FIG. 1, and may also be used, for example, in other well operations such as non-conductive production tubing operations, jointed tubing operations, coiled tubing operations, combinations thereof, and the like.

Figure 2A:
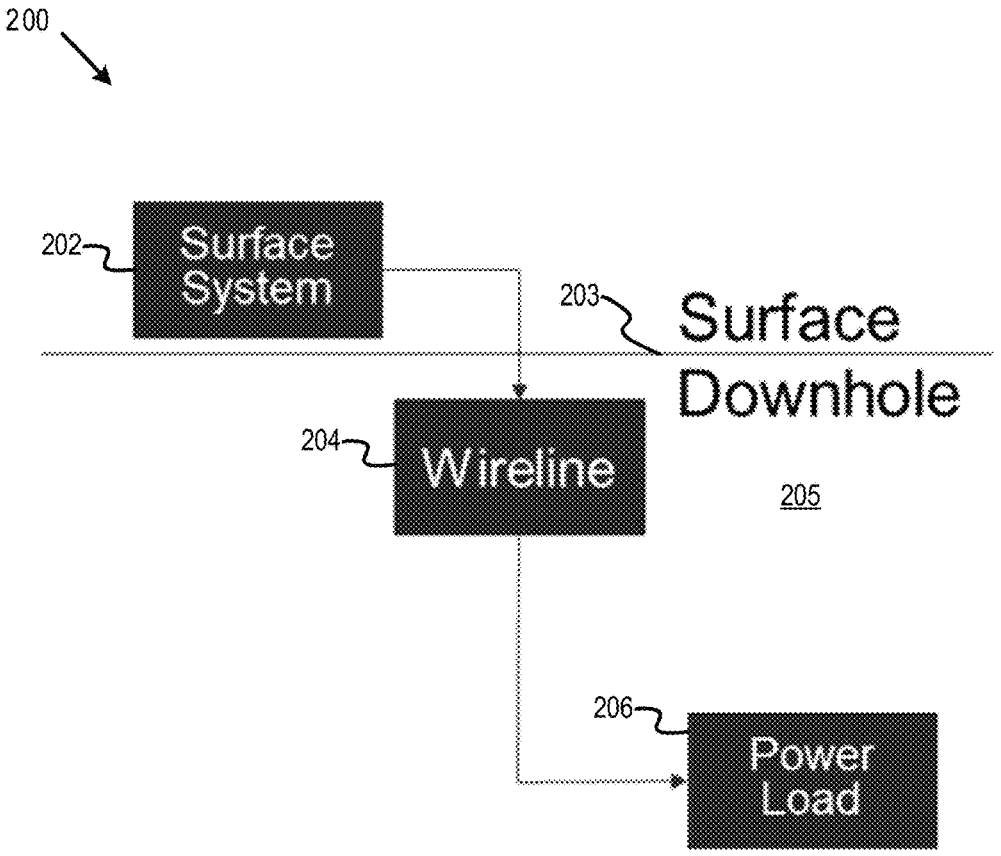
FIGS. 2A-2B are schematics depicting an example well intervention system, according to some implementations.
Figure 2B:
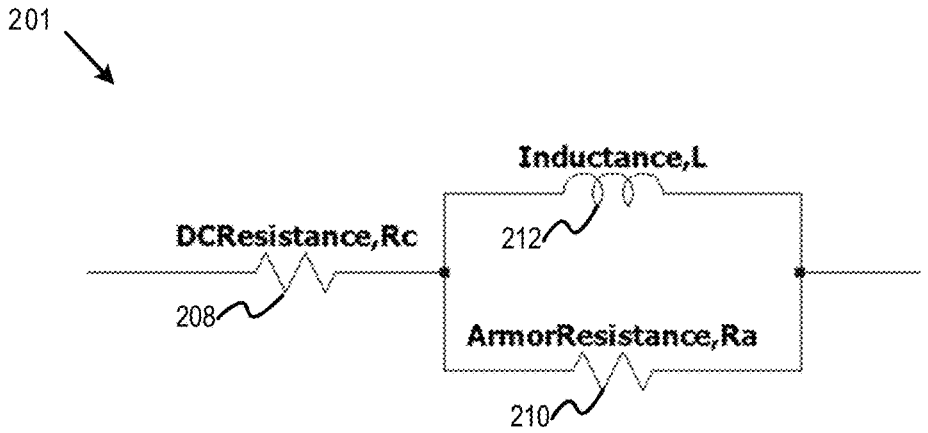

FIGS. 2A-2B are schematics depicting an example well intervention system, according to some implementations. FIGS. 2A-2B are described in reference to FIG. 1. FIG. 2A includes a well intervention system 200. The well intervention system includes a surface system 202 located on the surface 203. The surface system may include a truck (such as truck 115 of FIG. 1), a computer (such as a computer 190 of FIG. 1), a surface panel for user control of deploying a downhole tool in a borehole and/or controlling the downhole tool, a surface power system, etc. Additionally, the surface system 202 may include one or more surface voltage sensors and one or more surface current sensors to measure voltage and current, respectively, of the wireline 204 at the surface 203. The well intervention system 200 includes a downhole system comprising a downhole tool, a telemetry sub, a power load 206, etc. The power load 206 may represent power converters, motor controllers, etc. that may be coupled to a downhole tool positioned in a borehole in the subsurface 205. The downhole tool may also include one or more downhole voltage sensors and one or more downhole current sensors to measure downhole voltage and downhole current, respectively, as the downhole tool is powered on and being deployed in or out the borehole. A wireline 204 may physically and/or communicatively couple the surface system 202 to the power load 206. The wireline 204 may provide telemetry communication between the surface system 202 and the downhole sensors to determine wireline parameters during runtime of the downhole tool.

FIG. 2B includes a schematic of a wireline impedance model 201. Wireline impedance may induce a large response time to any dynamic load variation at the downhole tool to be detected by the surface system 202. The wireline impedance model 201 may be included in modeling the wireline to achieve accurate, fast, and/or reliable control and/or regulation of the downhole tool bus voltage from the surface system 202. The wireline impedance model 201 includes both DC and AC aspects that may be utilized to determine the wireline impedance while a downhole tool is being deployed in a borehole. DC aspects include the DC resistance 208 of the wireline 204. The AC aspects include the wireline armor resistance 210 and wireline inductance 212. The wireline armor may provide a discharge path for the stored energy in the wireline to discharge. Determining each of the aspects is further described herein.

Figure 3:
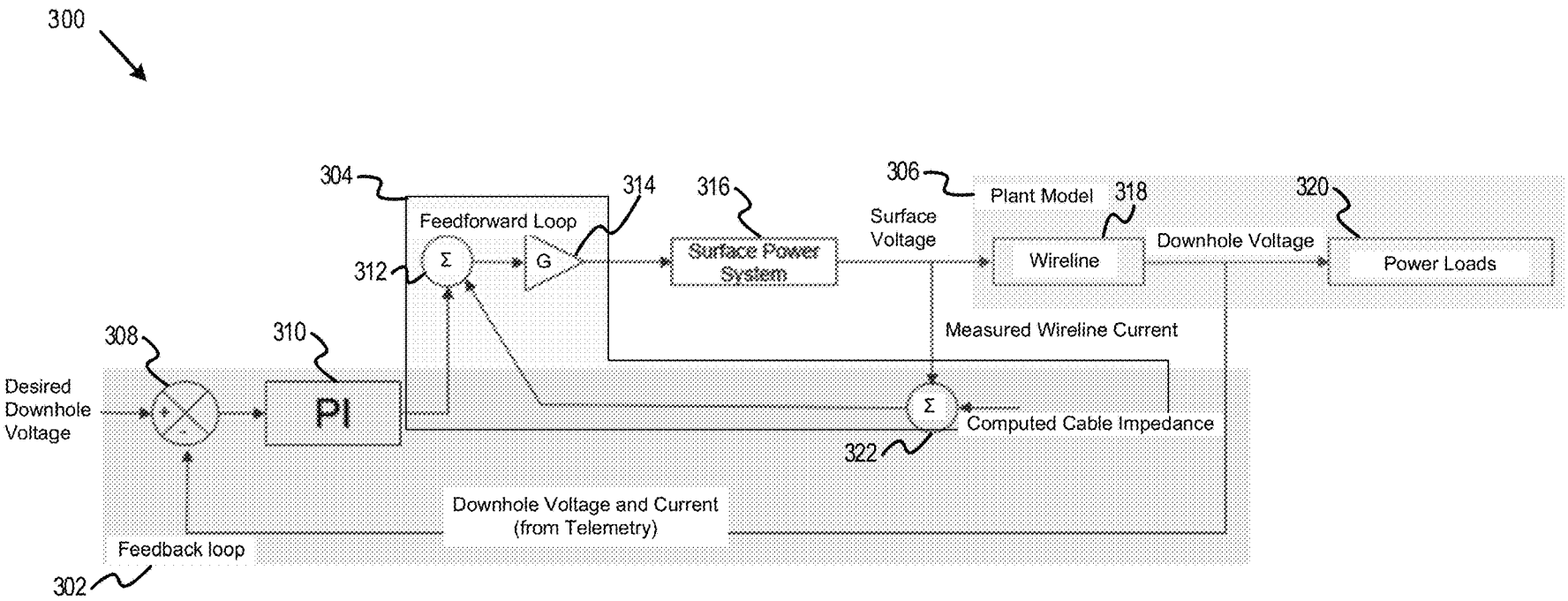
FIG. 3 is a schematic depicting a downhole tool bus voltage control system, according to some implementations.

FIG. 3 is a schematic depicting a downhole tool bus voltage control system, according to some implementations. FIG. 3 includes a downhole tool bus voltage controller 300 comprising a feedback loop 302, a feedforward loop 304, and a plant model 306. Within the feedback loop is an error calculator 308. A desired downhole tool bus voltage and the measured downhole tool bus voltage and/or current (obtained via downhole sensors on the downhole tool within the plant model 306 and communicated via telemetry) may be input into the error calculator 308. The error may then be input into the proportional-integral (PI) controller 310 to regulate the surface voltage. The surface voltage may then be fed into the feedforward loop 304 and combined with the wireline impedance 322 at point 312 to generate an effective surface voltage. A transfer function 314 may then be applied to the effective surface voltage such that the surface voltage is at a value that results in the downhole tool bus voltage being maintained at the desired downhole tool bus voltage. If the load is dynamic, then components of the feedback loop 302 and feedforward loop 304 may adjust the surface voltage as needed to maintain the desired downhole tool bus voltage. The effective surface voltage may then be applied to the surface power system 316 and fed to the plant model 306. The plant model 306 comprises the wireline 318 and the power load 320 (similar to the wireline 204 and power load 206 of FIG. 2A). The wireline 318 may exhibit a low frequency pole (i.e., in the order of 1 hertz (HZ) or less). Hence, this characteristic may introduce a large response time for any dynamic load variation at the power load 320 to be detected on the surface. Accordingly, the wireline impedance 322 (e.g., DC resistance and the AC aspects of the wireline) may be determined to improve the response time and accurately regulate the downhole tool bus voltage.

Example Operations

Examples operations are now described.

Figure 4:
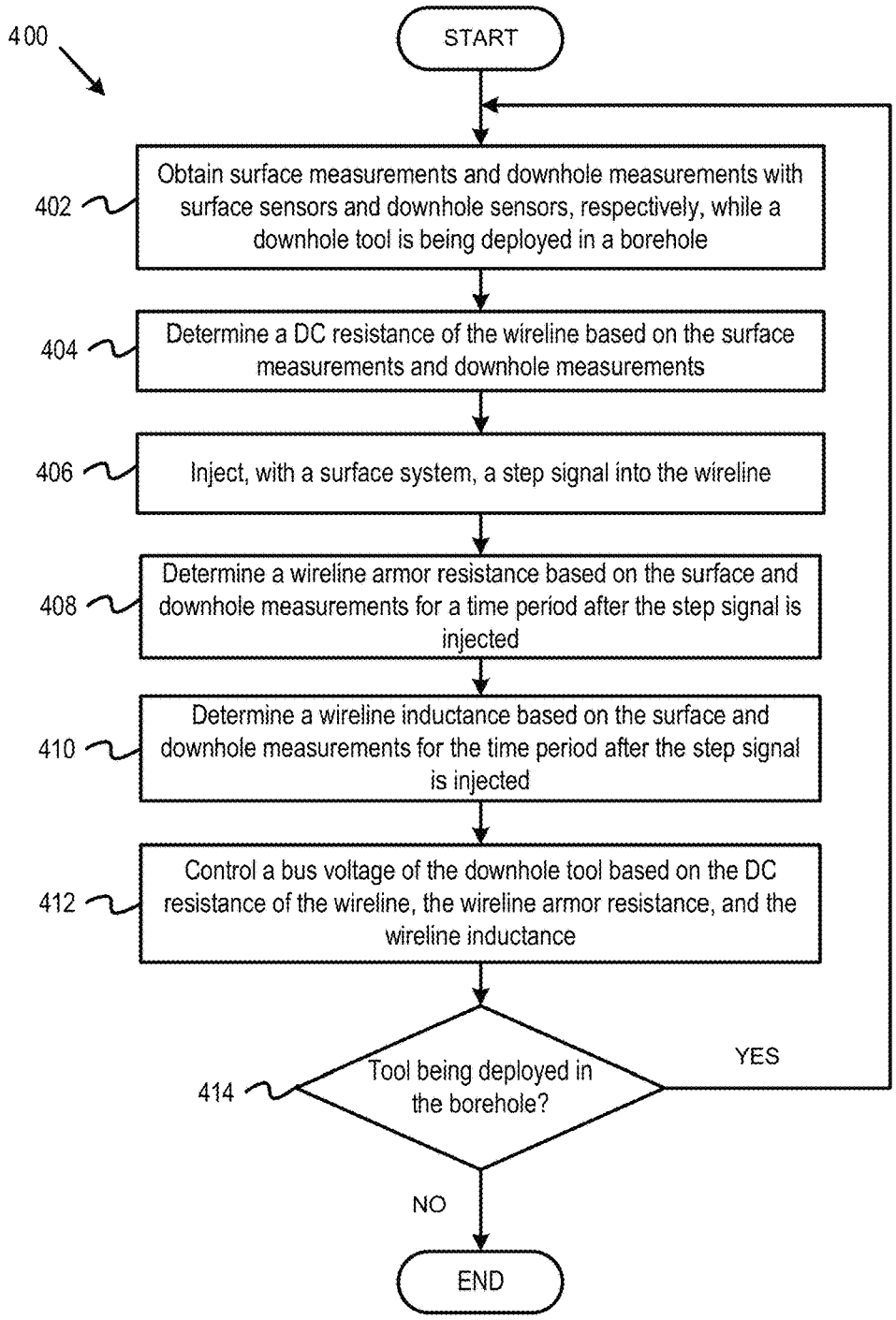
FIG. 4 is a flowchart depicting example operations for determining wireline parameters, according to some implementations.

FIG. 4 is a flowchart depicting example operations for determining wireline parameters, according to some implementations. FIG. 4 includes a flowchart 400 for continuously determining the DC resistance and AC aspects of a wireline as a downhole tool is powered on and being deployed in a borehole via the wireline. The operations of the flowchart 400 may be repeatedly performed during the runtime of the downhole tool. Operations of flowchart 400 of FIG. 4 are described in reference to the processor of the computer 190 of FIG. 1. Additionally, the operations of flowchart 400 are described in reference to FIG. 5. Operations of the flowchart 400 start at block 402.

At block 402, the processor of the computer 190 may obtain surface measurements and downhole measurements with surface sensors and downhole sensors, respectively, while a downhole tool is being deployed in a borehole. In some implementations, the downhole tool may be powered on while being deployed. For example, the downhole tool may be operating (e.g., logging the borehole) while running in or out of the borehole. Surface measurements may include surface voltage, surface current, etc. The surface sensors may be positioned on the surface, proximate the surface system and include one or more surface voltage sensors, one or more surface current sensor, etc. The downhole measurements include downhole voltage, downhole current, etc. The downhole sensors may be coupled to the downhole system, such as the downhole tool and include one or more surface voltage sensors, one or more surface current sensors, etc. The downhole measurements may be communicated, through telemetry, to the surface.

Figure 5A:
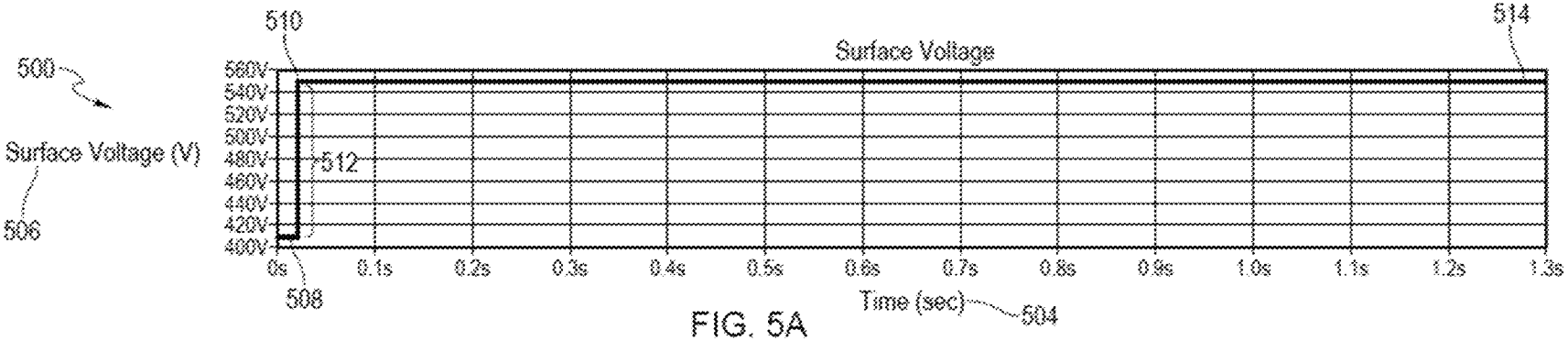
FIGS. 5A-5C are illustrations depicting example charts of surface measurements and downhole measurements, according to some implementations.
Figure 5B:
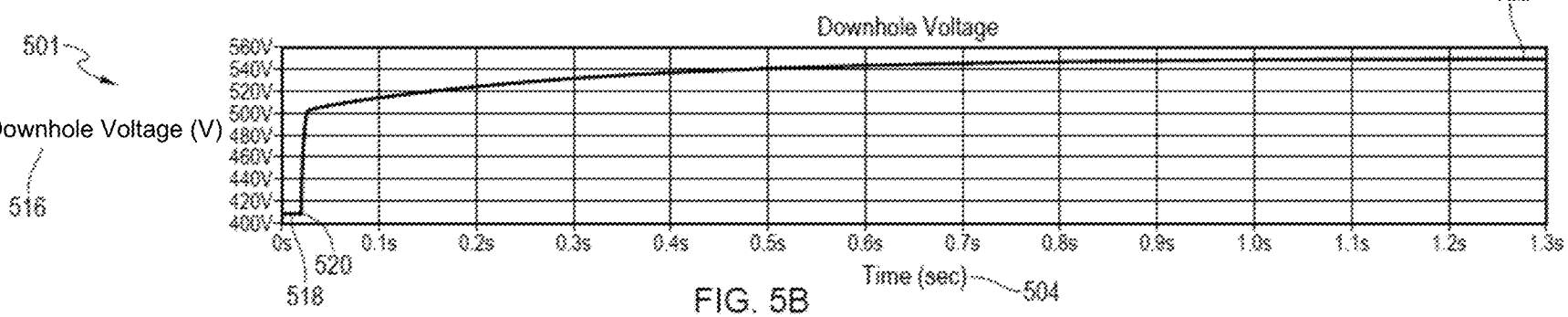
Figure 5C:
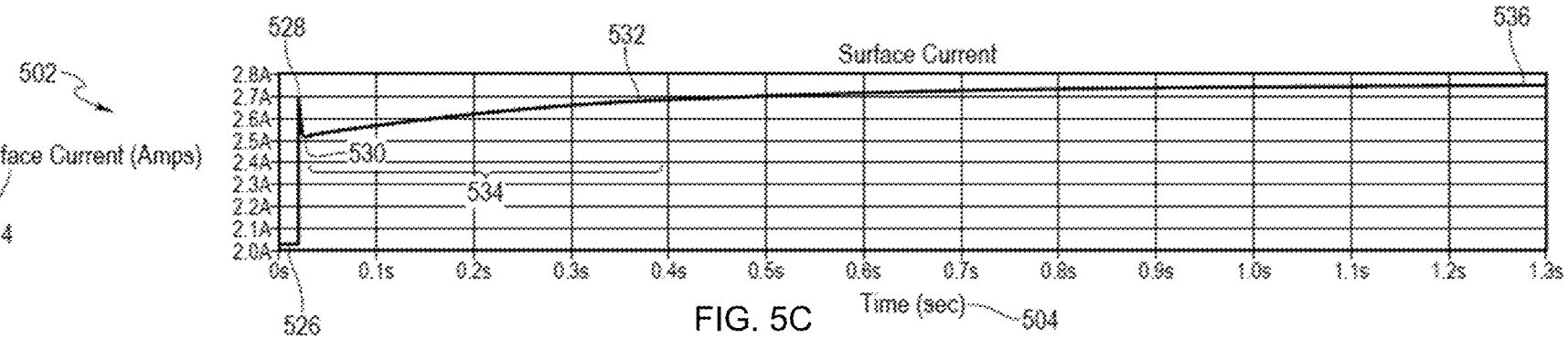

To help illustrate, FIGS. 5A-5C are illustrations depicting example charts of surface measurements and downhole measurements, according to some implementations. The surface measurements and downhole measurements may be recorded before, during, and after a step signal 512 (described below) is injected into the wireline at approximately 0.02 seconds. FIG. 5A is a chart of the surface voltage and includes an x-axis 504 and a y-axis 506. The x-axis 504 is the time and having units in seconds (sec). The y-axis 506 is the surface voltage obtained by the surface voltage sensor and having units in volts (V). FIG. 5B is a chart of the downhole voltage and includes an x-axis 504 and a y-axis 516. The x-axis 504 is the time and having units in seconds (sec). The y-axis 516 is the downhole voltage obtained by the downhole voltage sensor and having units in volts (V). FIG. 5C is a chart of the surface current and includes an x-axis 504 and a y-axis 524. The x-axis 504 is the time and having units in seconds (sec). The y-axis 524 is the surface current obtained by the surface current sensor and having units in amperes (Amps).

At block 404, the processor of the computer 190 may determine a DC resistance of the wireline based on the surface measurements and the downhole measurements. The DC resistance may be determined with the surface voltage measurements, downhole voltage measurements, and surface current measurements. For example, with reference to FIGS. 5A-5C, the DC resistance of the wireline cable, represented by $R_{cable.DC}$ (using Equation 1 below), may be defined as follows:

$$R_{cable.DC} = \frac{V_{surface.DC} - V_{downhole.DC}}{I_{surface.DC}} \tag{1}$$

where $V_{surface.DC}$ 508 is the surface voltage prior to the injected signal, $V_{downhole.DC}$ 518 is the downhole voltage prior to the injected signal, and $I_{surface.DC}$ 526 is the surface current prior to the injected signal.

At block 406, the processor of the computer 190 may inject, with the surface system, a step signal into the wireline. The step signal may create a transient behavior of the wireline as it unspools while the downhole tool is powered on. The step signal may be a pulse like signal that may be injected into the wireline by a coupling transformer, a coupling capacitor, perturbation of the wireline on the surface via relays/switches and additional resistors, etc. The step signal may have a time interval sufficiently long enough to capture the low frequency behavior of the wireline. For example, the time interval of the step signal may be several seconds long. The step signal may include a step voltage, such as step voltage 512 of FIG. 5A, that may be generated when a downhole calibration resistor is switched on. The downhole calibration resistor may be needed to allow a pulse like current to be detected on the surface when the step voltage is created on the surface. For example, when the downhole calibration resistor is switched on, a step current with an amplitude corresponding to the amplitude of the step voltage may be detected by the surface current sensor. Additionally, the corresponding step voltage and step current may be detected downhole by the downhole voltage sensor and the downhole current sensor, respectively.

At block 408, the processor of the computer 190 may determine a wireline armor resistance based on the surface and downhole measurements for a time period after the step signal is injected. For example, with reference to FIGS. 5A-5C, the wireline armor resistance, represented by $R_{cable.Armor}$ (using Equation 2 below), may be defined as follows:

$$R_{cable.Armor} = \frac{V_{surface.initial} - V_{downhole.initial}}{I_{surface.initial} - I_{surface.DC}} - R_{cable.DC} \tag{2}$$

where $V_{surface.initial}$ 510 is the surface voltage when the step voltage is injected, $V_{downhole.initial}$ 520 is the downhole voltage when the step voltage is injected and $I_{surface.initial}$ 528 is the surface current when the step voltage is injected.

At block 410, the processor of the computer 190 may determine a wireline inductance based on the surface and downhole measurements for the time period after the step signal is injected. In some implementations, due to the wireline inductance, the surface current may rise in an exponential manner because of the injected step voltage. To determine the wireline inductance, the surface step current amplitude may first need to be determined. For example, with reference to FIGS. 5A-5C, the surface step current amplitude, represented by $I_{step.amplitude}$ (using Equation 3 below), may be defined as follows:

$$I_{step.amplitude} = I_{surface.final} - I_{surface.dip} \tag{3}$$

where $I_{surface.final}$ 536 is the steady state surface current and $I_{surface.dip}$ 530 is the dip in the surface current before the exponential rise of the surface current.

The exponentially rising surface current, $I_{surface.rise}$ 530, may be obtained from the surface current measurements between the surface current dip, $I_{surface.dip}$ 530, and the final surface current, $I_{surface.final}$ 536. The time between the surface current dip, $I_{surface.dip}$ 530, and final surface current, $I_{surface.final}$ may represent the time interval, $\Delta t_{surface.rise}$ 534, for the exponential rise after the injected step voltage. With $I_{surface.rise}$ 532 and $\Delta t_{surface.rise}$ 534 known, the wireline inductance may now be generated. For example, with reference to FIGS. 5A-5C, the wireline inductance, represented by $L_{cable}$ (using Equation 2 below), may be defined as follows:

$$L_{cable} = \frac{-\Delta t_{surface.rise} * \frac{(R_{cable.DC} + R_{cal}) * R_{cable.Armor}}{R_{cable.DC} + R_{cal} + R_{cable.Armor}}}{\ln\left(1 - \frac{I_{surface.rise}}{I_{step.amplitude}}\right)} \quad (4)$$

where $R_{cal}$ is the downhole calibration resistance. This calibration resistor, when switched on may be parallel to the downhole power load 206 in FIG. 2A. This calibration resistor may allow the step current as shown in FIG. 5C to be measurable by the current sensors.

At block 412, the processor of the computer 190 may control a bus voltage of the downhole tool based on the DC resistance of the wireline, the wireline armor resistance, and the wireline inductance. The DC resistance and AC aspects (the wireline armor resistance and the wireline inductance) may be utilized to model the wireline impedance of the wireline. As a result, the surface system may adjust the surface voltage as needed to control and/or regulate the downhole tool bus voltage to maintain a desired bus voltage. For example, the surface voltage may be increased, decreased, and or unchanged based on the DC resistance and AC aspects.

At block 414, the processor of computer 190 may determine if the downhole tool is being deployed in the borehole. If the tool is still being deployed in the borehole, then operations return to block 402 to determine the wireline impedance (parameters) for the next time period. Otherwise, operations of flowchart 400 are complete.

Example Computer

FIG. 6 is a block diagram depicting an example computer, according to some embodiments. FIG. 6 depicts a computer 600 for determining wireline parameters while deploying a downhole tool in a wellbore. The computer 600 includes a processor 601 (possibly including multiple processors, multiple cores, multiple nodes, and/or implementing multithreading, etc.). The computer 600 includes memory 607. The memory 607 may be system memory or any one or more of the above already described possible realizations of machine-readable media. The computer 600 also includes a bus 603 and a network interface 605. The computer 600 can communicate via transmissions to and/or from remote devices via the network interface 605 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 600 also includes a signal processor 611 and a controller 615 which may perform the operations described herein. For example, the signal processor 611 may process surface and downhole measurements obtained from surface and downhole sensors, respectively. The signal processor 611 may also determine the DC resistance and the AC aspects of the wireline. The controller 615 may control and/or regulate the downhole tool bus voltage based on the DC resistance and AC aspects of the wireline. The signal processor 511 and the controller 515 can be in communication. Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and exploitations, it will be understood that these aspects are illustrative and that the scope of the claims is not limited to them. In general, techniques for seismic horizon mapping as described herein may be implemented with facilities consistent with any hardware system or hardware systems. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

EXAMPLE EMBODIMENTS

Implementation #1: A method comprising: deploying, in a borehole, a downhole tool coupled to a surface system by a wireline; and repeating the following operations while the downhole tool is powered on and being deployed in the borehole, obtaining surface measurements, via surface sensors, and downhole measurements, via downhole sensors; determining a DC resistance of the wireline based on the surface measurements and the downhole measurements; injecting a step signal into the wireline from the surface system; determining AC aspects of the wireline based the surface measurements and the downhole measurements at a time period after injecting the step signal into the wireline; and controlling a bus voltage of the downhole tool based on the DC resistance and the AC aspects.

Implementation #2: The method of Implementation #1, wherein the surface measurements include at least one of a surface voltage and a surface current, and wherein the downhole measurements include a downhole voltage.

Implementation #3: The method of Implementation #1 or 2, wherein the AC aspects includes at least one of a wireline armor resistance and a wireline inductance.

Implementation #4: The method of Implementation #3 further comprising; determining an amplitude of an exponential rise of a surface current at the time period after injecting the step signal; determining a time interval of the exponential rise of the surface current; and determining the wireline inductance based on the amplitude and the time interval.

Implementation #5: The method of any one or more of Implementations #1-4, wherein the step signal includes a step voltage.

Implementation #6: The method of any one or more of Implementations #1-5 further comprising; switching a downhole calibration resistor on while deploying the downhole tool in the borehole.

Implementation #7: The method of any one or more of Implementations #1-6, wherein injecting the step signal includes injecting with at least one of a coupling transformer or a coupling capacitor.

Implementation #8: A system comprising: a downhole tool; a wireline coupling the downhole tool and a surface system; one or more surface sensor configured to obtain surface measurements; one or more downhole sensors configured to obtain downhole measurements; a processor; and a computer-readable medium having instructions stored thereon that are executable by the processor to cause the processor to repeat the following operations while the downhole tool is powered on and being deployed in a borehole, obtain the surface measurements and the downhole measurements; determine a DC resistance of the wireline based on the surface measurements and the downhole measurements; inject a step signal into the wireline from the surface system; determine AC aspects of the wireline based the surface measurements and the downhole measurements at a time period after injecting the step signal into the wireline; and control a bus voltage of the downhole tool based on the DC resistance and the AC aspects.

Implementation #9: The system of Implementation #8, wherein the surface measurements include at least one of a surface voltage and a surface current, and wherein the downhole measurements include a downhole voltage.

Implementation #10: The system of Implementation #8 or 9, wherein the AC aspects includes at least one of a wireline armor resistance and a wireline inductance.

Implementation #11: The system of Implementation #10 further comprising; determining an amplitude of an exponential rise of a surface current at the time period after injecting the step signal; determining a time interval of the exponential rise of the surface current; and determining the wireline inductance based on the amplitude and the time interval.

Implementation #12: The system of any one or more of Implementations #8-11, wherein the step signal includes a step voltage.

Implementation #13: The system of any one or more of Implementations #8-12 further comprising; switching a downhole calibration resistor on while deploying the downhole tool in the borehole.

Implementation #14: The system of any one of more of Implementations #8-13, wherein injecting the step signal includes injecting with at least one of a coupling transformer or a coupling capacitor.

Implementation #15: A non-transitory, computer-readable medium having instructions stored thereon that are executable by a processor to perform operations comprising: deploying, in a borehole, a downhole tool coupled to a surface system by a wireline; and repeating the following operations while the downhole tool is powered on and being deployed in the borehole, obtaining surface measurements, via surface sensors, and downhole measurements, via downhole sensors; determining a DC resistance of the wireline based on the surface measurements and the downhole measurements; injecting a step signal into the wireline from the surface system; determining AC aspects of the wireline based the surface measurements and the downhole measurements at a time period after injecting the step signal into the wireline; and controlling a bus voltage of the downhole tool based on the DC resistance and the AC aspects.

Implementation #16: The non-transitory, computer-readable medium of Implementation #15, wherein the surface measurements include at least one of a surface voltage and a surface current, and wherein the downhole measurements include a downhole voltage.

Implementation #17: The non-transitory, computer-readable medium of Implementation #15 or 16, wherein the AC aspects includes at least one of a wireline armor resistance and a wireline inductance.

Implementation #18: The non-transitory, computer-readable medium of Implementation #17 further comprising; determining an amplitude of an exponential rise of a surface current at the time period after injecting the step signal; determining a time interval of the exponential rise of the surface current; and determining the wireline inductance based on the amplitude and the time interval.

Implementation #19: The non-transitory, computer-readable medium of any one of more of Implementation #15-18, wherein the step signal includes a step voltage.

Implementation #20: The non-transitory, computer-readable medium of any one or more of Implementation #15-19 further comprising; switching a downhole calibration resistor on while deploying the downhole tool in the borehole.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method comprising:

deploying, in a borehole, a downhole tool coupled to a surface system by a wireline; and repeating the following operations while the downhole tool is powered on and being deployed in the borehole, obtaining surface measurements, via surface sensors, and downhole measurements, via downhole sensors;

determining a DC resistance of the wireline based on the surface measurements and the downhole measurements;

injecting a step signal into the wireline from the surface system;

determining AC aspects of the wireline based on the surface measurements and the downhole measurements at a time period after injecting the step signal into the wireline; and controlling a bus voltage of the downhole tool based on the DC resistance and the AC aspects.

2. The method of claim 1, wherein the surface measurements include at least one of a surface voltage and a surface current, and wherein the downhole measurements include a downhole voltage.

3. The method of claim 1, wherein the AC aspects includes at least one of a wireline armor resistance and a wireline inductance.

4. The method of claim 3 further comprising;

determining an amplitude of an exponential rise of a surface current at the time period after injecting the step signal;

determining a time interval of the exponential rise of the surface current; and determining the wireline inductance based on the amplitude and the time interval.

5. The method of claim 1, wherein the step signal includes a step voltage.

6. The method of claim 1 further comprising;

switching a downhole calibration resistor on while deploying the downhole tool in the borehole.

7. The method of claim 1, wherein injecting the step signal includes injecting with at least one of a coupling transformer or a coupling capacitor.

8. A system comprising:

a downhole tool;

a wireline coupling the downhole tool and a surface system;

one or more surface sensors configured to obtain surface measurements;

one or more downhole sensors configured to obtain downhole measurements;

a processor; and a computer-readable medium having instructions stored thereon that are executable by the processor to cause the processor to repeat the following operations while the downhole tool is powered on and being deployed in a borehole, obtain the surface measurements and the downhole measurements;

determine a DC resistance of the wireline based on the surface measurements and the downhole measurements;

inject a step signal into the wireline from the surface system;

determine AC aspects of the wireline based on the surface measurements and the downhole measurements at a time period after injecting the step signal into the wireline; and control a bus voltage of the downhole tool based on the DC resistance and the AC aspects.

9. The system of claim 8, wherein the surface measurements include at least one of a surface voltage and a surface current, and wherein the downhole measurements include a downhole voltage.

10. The system of claim 8, wherein the AC aspects includes at least one of a wireline armor resistance and a wireline inductance.

11. The system of claim 10 further comprising;

determining an amplitude of an exponential rise of a surface current at the time period after injecting the step signal;

determining a time interval of the exponential rise of the surface current; and determining the wireline inductance based on the amplitude and the time interval.

12. The system of claim 8, wherein the step signal includes a step voltage.

13. The system of claim 8 further comprising;

switching a downhole calibration resistor on while deploying the downhole tool in the borehole.

14. The system of claim 8, wherein injecting the step signal includes injecting with at least one of a coupling transformer or a coupling capacitor.

15. A non-transitory, computer-readable medium having instructions stored thereon that are executable by a processor to perform operations comprising:

deploying, in a borehole, a downhole tool coupled to a surface system by a wireline; and repeating the following operations while the downhole tool is powered on and being deployed in the borehole, obtaining surface measurements, via surface sensors, and downhole measurements, via downhole sensors;

determining a DC resistance of the wireline based on the surface measurements and the downhole measurements;

injecting a step signal into the wireline from the surface system;

determining AC aspects of the wireline based on the surface measurements and the downhole measurements at a time period after injecting the step signal into the wireline; and controlling a bus voltage of the downhole tool based on the DC resistance and the AC aspects.

16. The non-transitory, computer-readable medium of claim 15, wherein the surface measurements include at least one of a surface voltage and a surface current, and wherein the downhole measurements include a downhole voltage.

17. The non-transitory, computer-readable medium of claim 15, wherein the AC aspects includes at least one of a wireline armor resistance and a wireline inductance.

18. The non-transitory, computer-readable medium of claim 17 further comprising;

determining an amplitude of an exponential rise of a surface current at the time period after injecting the step signal;

determining a time interval of the exponential rise of the surface current; and determining the wireline inductance based on the amplitude and the time interval.

19. The non-transitory, computer-readable medium of claim 15, wherein the step signal includes a step voltage.

20. The non-transitory, computer-readable medium of claim 15 further comprising;

switching a downhole calibration resistor on while deploying the downhole tool in the borehole.

* * * * *